US007369011B2

(12) United States Patent
Chang et al.

(10) Patent No.: US 7,369,011 B2
(45) Date of Patent: May 6, 2008

(54) HIGH ORDER MODE ELECTROMAGNETIC WAVE COUPLER AND COUPLING METHOD USING PROPORTIONAL DISTRIBUTING WAVES

(75) Inventors: Tsun-Hsu Chang, Hsinchu (TW); Ching-Fang Yu, Taoyuan (TW)

(73) Assignee: National Tsing Hua University, Hsinchu (TW)

( * ) Notice: Subject to any disclaimer, the term of this patent is extended or adjusted under 35 U.S.C. 154(b) by 205 days.

(21) Appl. No.: 11/346,140

(22) Filed: Feb. 3, 2006

(65) Prior Publication Data

US 2007/0182507 A1 Aug. 9, 2007

(51) Int. Cl.
*H01P 5/00* (2006.01)
*H01P 5/20* (2006.01)
*H01P 1/16* (2006.01)

(52) U.S. Cl. ..... 333/125; 333/21 R; 333/121; 333/122

(58) Field of Classification Search ..... 333/21 R, 333/21 A, 117, 121, 122, 125
See application file for complete search history.

(56) References Cited

U.S. PATENT DOCUMENTS 2,730,677 A * 1/1956 Boissinot et al. ..... 333/21 R
3,320,553 A * 5/1967 Howard ..... 333/121
3,758,880 A * 9/1973 Morz ..... 333/122
6,087,908 A * 7/2000 Haller et al. ..... 333/122

* cited by examiner

*Primary Examiner*—Benny Lee
*Assistant Examiner*—Kimberly E Glenn
(74) *Attorney, Agent, or Firm*—Egbert Law Offices.

(57) ABSTRACT

The high order mode electromagnetic wave coupler and coupling method uses one or more Y-shaped bifurcated waveguides to divide the wave to one or more order, so as to divide the target electromagnetic wave proportionally into equal shares. The waveguide is used to inject the electromagnetic wave to a main waveguide, so that the electromagnetic wave is converted into high order mode in the main waveguide. For example, a rectangular waveguide $TE_{10}$ mode can be converted to a circular $TE_{01}$ mode, wherein this conversion can also be applied to higher order modes and microwave guide-shaped modes. The coupling method includes a electromagnetic wave power dividing section and mode converting section, of which the power divider and dividing method can divide the electromagnetic wave proportionally. The coupler and coupling method feature high converting efficiency, high mode purity, high bandwidth, and convenient operation.

6 Claims, 8 Drawing Sheets

HIGH ORDER MODE ELECTROMAGNETIC WAVE COUPLER AND COUPLING METHOD USING PROPORTIONAL DISTRIBUTING WAVES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a high order mode electromagnetic wave coupler and coupling method using proportional distributing waves, and more particularly to a coupling technology that converts the rectangular waveguide $TE_{10}$ mode to the circular waveguide $TE_{01}$ mode.

BACKGROUND OF THE INVENTION

The $TE_{01}$ mode, having advantages of field azimuthal symmetry and low propagating loss, is widely used in microwave applications, such as in gyrotron microwave sources. When applied to microwave plasma heating, the symmetrical distribution of the circular $TE_{01}$ mode is expected to make heating more evenly.

Two methods have been classified to generate the $TE_{01}$ mode with a cylindrical waveguide. One method is in-line coupling, and another is sidewall coupling. The former uses a deformed waveguide structure to convert a wave into the desired mode gradually. The transition length is generally long, and multiple modes could be excited during the converting process, wherein a Tantawi converter is commonly used. The latter, sidewall coupling, often uses a long and straight waveguide with coupling holes on the sidewall. Like the in-line converter, this type of converter needs converter components with longer lengths so that the electric wave can be converted slowly to the desired mode. However, during the converting process, the waves of the unwanted modes will interact with the electron beam, which will result in serious mode competition. Therefore, shortening the transition length and improving the mode purity could effectively lower the possibility of mode competition.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The primary objective of the present invention is to provide a high order mode electromagnetic wave coupler using proportional distributing waves. The invention comprises an electromagnetic wave power divider, being comprised of a Y-shaped bifurcated waveguide to divide the wave to one or more orders. The divided wave is proportional so that the electromagnetic wave has a symmetric magnitude after passing through the bifurcated rectangular waveguide, and so that the electromagnetic wave can distribute the waves to a position with a suitable angle after passing through the curved waveguide. The wave is then injected into the mode converter; therefore, the coupler features high converting efficiency, high mode purity, high bandwidth, and convenient operation.

Another objective of the present invention is to provide a high order mode electromagnetic wave coupling method using proportional distributing waves, being comprised of a power divider and mode-converter. The high order mode electromagnetic wave coupler, using a coupling method based upon proportional distributing waves, includes an electromagnetic wave power divider (section), having one or more Y-shaped bifurcated waveguides to divide the wave to one or more orders. The input end of the Y-shaped bifurcated waveguide is a rectangular waveguide, and the other end is split into two rectangular waveguides. Each Y-shaped bifurcated waveguide is connected to the power divider by a curved waveguide. The divided wave is proportional so that the electromagnetic wave has a symmetric magnitude after passing through the bifurcated rectangular waveguide, and so that the electromagnetic wave can distribute the waves to a position with a suitable angle, after passing through the curved waveguide. Then, the wave is injected into the mode converter (section). The other end of Y-shaped bifurcated waveguide is split into two rectangular waveguides, so that a slightly tapered section is connected to the end of the Y-shaped bifurcated waveguide through a curved waveguide.

The invention also includes a mode-converter (section), which comprises a main waveguide, which has corresponding coupling holes on the sidewall. The electromagnetic wave is coupled by the rectangular waveguides that are connected to the curved waveguide into a polarized wave.

The present invention provides a new high-efficiency $TE_{01}$ mode coupler, specifically a high order mode electromagnetic wave coupler and coupling method. The coupler features reduced converting components (main waveguide 21), high converting efficiency (shortened transition length), high mode purity (99.99%), high bandwidth, and convenient operation.

For example, converting a linear polarized wave from rectangular waveguide $TE_{10}$ mode to a circular waveguide $TE_{01}$ mode is based on the above-mentioned principles. The method extends to other high order and microwave guide-shaped mode conversions. The $TE_{01}$ mode has drawn much attention in a variety of applications, such as Electron Cyclotron Maser (ECM) based gyrotron microwave sources, microwave systems, electromagnetic input and output devices, including microwave equipment, microwave plasma sources, microwave material processing, as well as applications in telecommunications industry and national defense industry. Among a wide range of selection in couplers for microwave, the circular $TE_{01}$ mode is commonly used due to its features of azimuthally symmetric electric field and low ohmic loss. The $TE_{01}$ mode in the present invention has high mode purity of 99.9%, and the converting efficiency is 98.5%, which is superior to conventional methods.

The electromagnetic wave power divider A of the present invention has two Y-shaped bifurcated waveguides 11 to divide the wave to one or more orders. The divided wave is proportional so that the electromagnetic wave has symmetric magnitude after passing through the bifurcated rectangular waveguide 111, and so that the electromagnetic wave can distribute the waves to a position with suitable angle after passing through the curved waveguide 110. Then, the wave is injected into the mode converter B. The coupler features high converting efficiency, high mode purity, high bandwidth, and convenient operation. The coupler can generate multiple coupling modes, $TE_{01}$, $TE_{21}$, $TE_{31}$, $TE_{41}$, $TE_{51}$.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
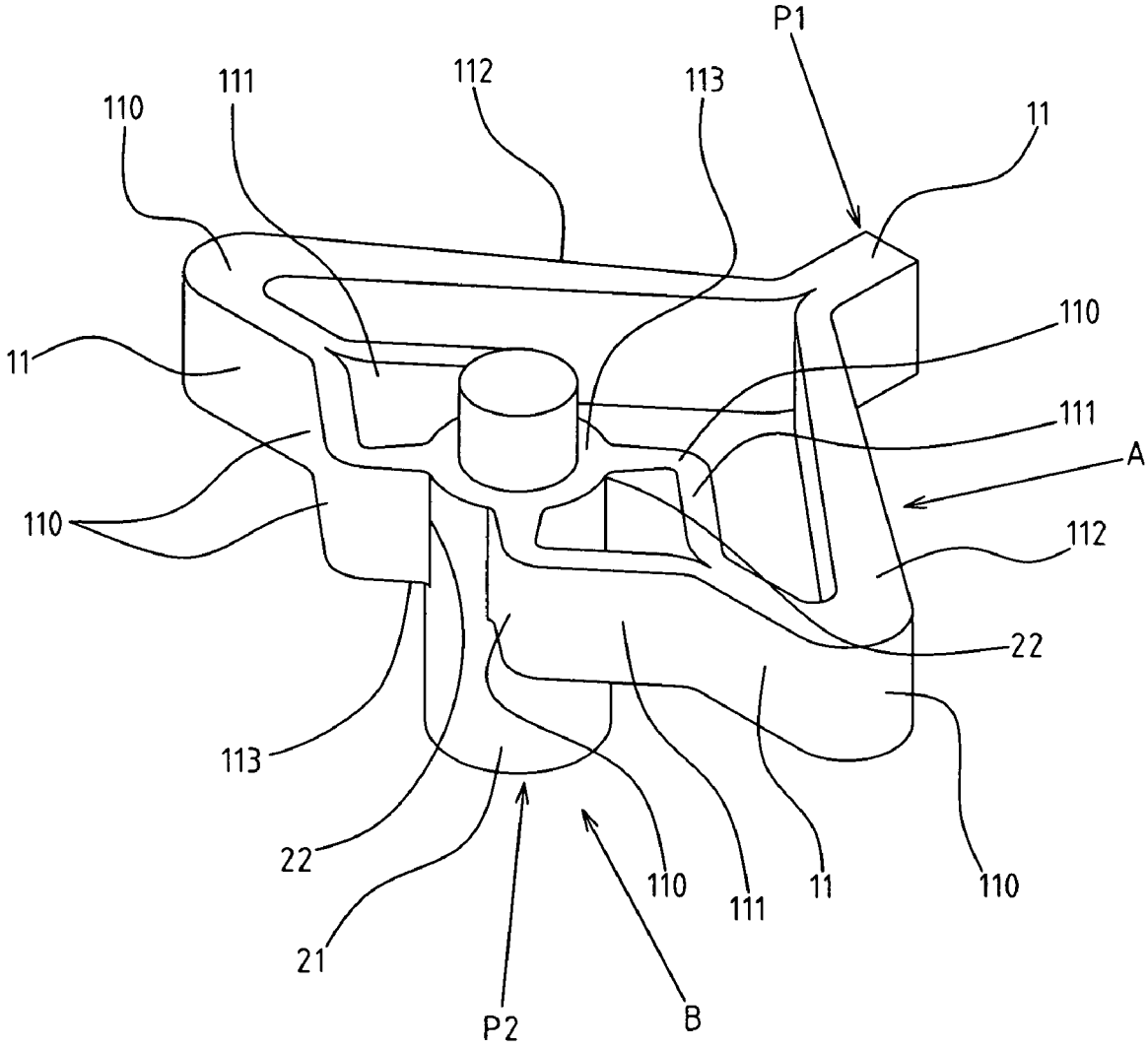
FIG. 1 shows a perspective view of the assembled electromagnetic wave coupler.

As shown in FIG. 1, there a high order mode electromagnetic wave coupler using proportional distributing waves.

The invention includes an electromagnetic wave power divider A, which has one or more Y-shaped bifurcated waveguides 11 to divide the wave to one or more orders. The input end of the Y-shaped bifurcated waveguide 11 is a rectangular waveguide, and the other end is split into two rectangular waveguides. Each Y-shaped bifurcated waveguide 11 is connected to the power divider by a curved waveguide 110. The divided wave is proportional so that the electromagnetic wave has symmetric magnitude after passing through the bifurcated rectangular waveguide 111, and so that the electromagnetic wave can distribute the waves to a position with suitable angle after passing through the curved waveguide 110. Then, the wave is injected into the mode converter B. The other end of Y-shaped bifurcated waveguide 11 is split into two rectangular waveguides 111, so that a slightly tapered section 112 is connected to the end of the Y-shaped bifurcated waveguide 111 through a curved waveguide 110. The curved waveguide 110 is connected to the mode converter B, so that an optimized connector 113 could be set.

The invention also includes a mode-converter B, which has a main waveguide 21 with corresponding coupling holes 22 on the sidewall. The electromagnetic wave is coupled by the rectangular waveguides 111 that are connected to the curved waveguide 110 into a polarized wave.

The Y-shaped bifurcated waveguide 11 of the electromagnetic wave power divider A forms an included angle of less than 180. For the mode converter B, the cross-section shape of the main waveguide 21 is optimized for coupling efficiency between the rectangular and columnar waveguides.

Based on the structure, a high order mode electromagnetic wave coupling method uses proportional distributing waves.

A first section is the electromagnetic wave power dividing section, which has one or more Y-shaped bifurcated waveguides 11 to divide the wave to one or more orders. The divided wave is proportional. A slightly tapered section 112 is connected to the end of the Y-shaped bifurcated waveguide 11 so that the electromagnetic wave has a symmetric magnitude after passing through the bifurcated rectangular waveguide 111, which is then connected through a curved waveguide 110 to distribute the waves to a position with suitable angle. An optimized connector 113 can now be set.

A second section uses a main waveguide 21, in which the electromagnetic wave is coupled into a polarized wave by injecting into the rectangular waveguides 111 that are connected to the curved waveguide 110.

For the electromagnetic wave power divider A, the possible converting modes based on different amounts of evenly distributed energy are shown below:

(one time division)

split to 2: use the $TE_{21}$, mode as the main converting mode, and the remaining includes $TE_{mn}$, m=0,1,2,4,6,8 . . . , n=1,2,3,4,5 . . . whereas, m=multiples of 0, 1 and 2, n=1 or above;

(multiple divisions)

split to 3: use the $TE_{01}$, $TE_{31}$ modes as the main converting modes, and the remaining includes $TE_{mn}$, m=0,3, 6,9,12 . . . , n=1,2,3,4,5 . . . whereas, m=multiples of 0 and 3, n=1 or above;

split to 4: use the $TE_{01}$, $TE_{41}$ modes as the main converting modes, and the remaining includes $TE_{mn}$, m=0,4, 8,12,16 . . . , n=1,2,3,4,5 . . . whereas, m=multiples of 0 and 4, n=1 or above; and split to 5: use the $TE_{01}$, $TE_{51}$ modes as the main converting modes, and the remaining includes $TE_{mn}$, m=0,5, 10,15 . . . , n=1,2,3,4,5 . . . whereas, m=multiples of 0 and 5, n=1 or above, and so on.

The present invention uses a polarized $TE_{01}$ mode converter as an example. The mode converting process consists of two sections. The first section is the electromagnetic wave power dividing section, which has one or more Y-shaped bifurcated waveguides 11 to divide the wave to one or more orders. The input end of the Y-shaped bifurcated waveguide 11 is a rectangular waveguide, and the other end is split into two rectangular waveguides. Each Y-shaped bifurcated waveguide 11 is connected to the power divider by a curved waveguide 110. A slightly tapered section 112 is connected to the end of the Y-shaped bifurcated waveguide 11 to minimize the reflection. The divided wave is proportional so that the electromagnetic wave has symmetric magnitude after passing through the bifurcated rectangular waveguide 111, and so that the electromagnetic wave can distribute the waves to a position with a suitable angle after passing through the curved waveguide 110. Then, the wave is injected into the mode converter B, to generate multiple signals with equal amplitude and electric fields. The second section is the mode converting section, in which the signal is transmitted into a main waveguide 21 to form a pure polarized TE01 mode. The following discusses the operating principles and design details of each section.

A. Power Dividing Section: Minimize the Input Reflection

Figure 2A:
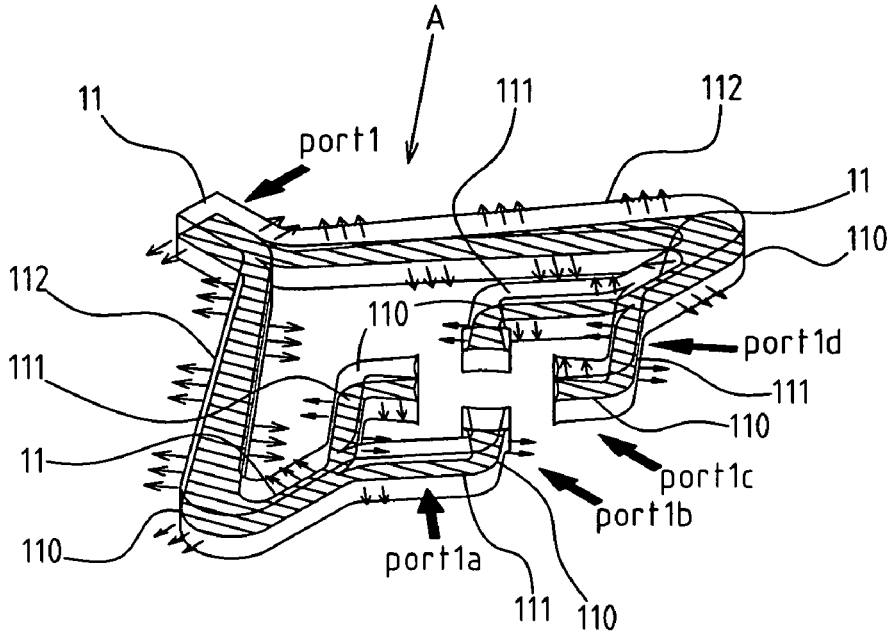
FIG. 2*a* shows a cross-section view of the electric field distribution and the electric field direction with HFSS at the power dividing section.
Figure 2B:
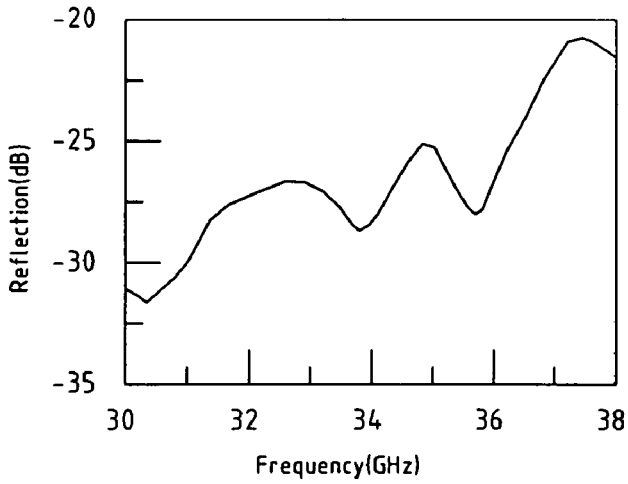
FIG. 2*b* shows a schematic view of the reflection coefficient of the input port.

The reflection is minimized by optimizing the geometry of the Y-splitters. An input power is first divided into two equal amplitude signals through a Y-shaped bifurcated power divider 11. A slightly tapered section 112 is connected to the end of the Y-shaped bifurcated waveguide 11 to minimize the reflection. The signal is divided in the bifurcated rectangular waveguide 111 after passing through the curved waveguide 110. The curved waveguide 110 and slightly tapered horn 112 can be shut completely to minimize multiple reflections. Then, multiple signals are outputted with suitable angles and equal amplitudes after passing through the waveguide 11 or optimized connector 113. FIG. 2*a* shows the cross-section view of the electric field distribution and the electric field direction with HFSS at the power dividing section. FIG. 2*b* shows the reflection coefficient of the input port. The reflection of input port P1—rectangular waveguide 11 is minimized by optimizing the geometry of the Y-splitters. The figure shows the reflection of the entire frequency band below 20 dB. At the end of the four output ports (ports 1*a-d*), the color spectrums are the same, but the electric field orientations are differed. This means, at this moment, all the field strengths are the same but the direction is clockwise. The electric field distribution and the electric field direction with HFSS shown in the cross-section view (FIG. 2*a*) show the reflection coefficient of the input port and can minimize multiple reflections. The only reflection signal is detected at input port P1. The reflection coefficient of the entire frequency range is better than that of 20 dB. Therefore, though the optimized frequency is not at the center, it has an insignificant effect on the performance of the coupling device. The mode converter determines the bandwidth of the coupling device, as shown below and discussed herein.

B. Mode Converting Stage: Optimize the Transmission Effect

Figure 3A:
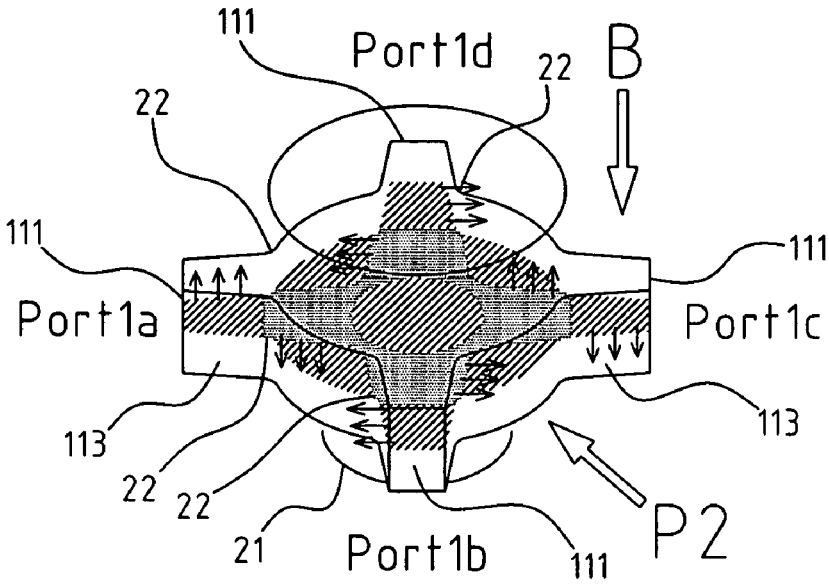
FIG. 3*a* shows a cross-section view of the electric field distribution with HFSS.
Figure 3B:
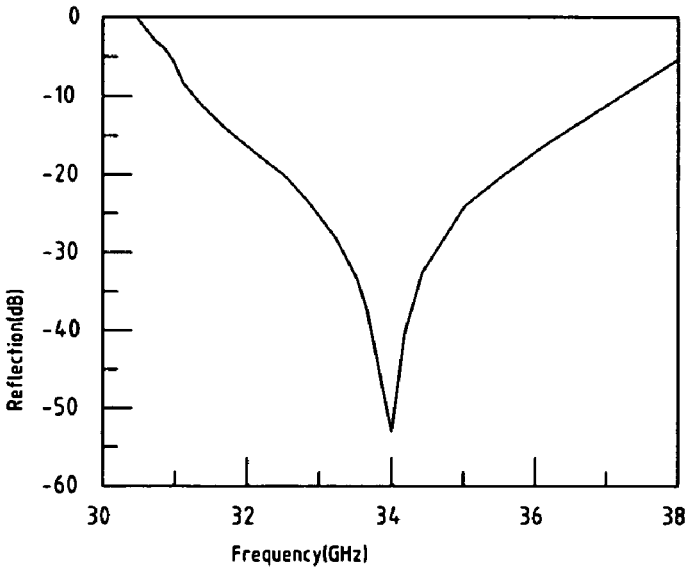
FIG. 3*b* shows a graph illustration of the transmission frequency reaction of the four rectangular $TE_{10}$ modes to circular $TE_{01}$ mode.

The first section generates multiple signals with equal magnitude but different electric field orientations. In the second section, the signals excite the desired $TE_{01}$ mode, the size of the optimized connector 113 of the sidewall being optimized to provide effective coupling between the rectangular and cylindrical waveguide. FIG. 3*a* shows the cross-section view of the electric field distribution with HFSS. The wave is injected into each rectangular waveguide 111 after passing through the optimized connector 113 of the curved waveguide 110, and it forms a polarized $TE_{01}$ mode at the main waveguide 21.

Figure 4A:
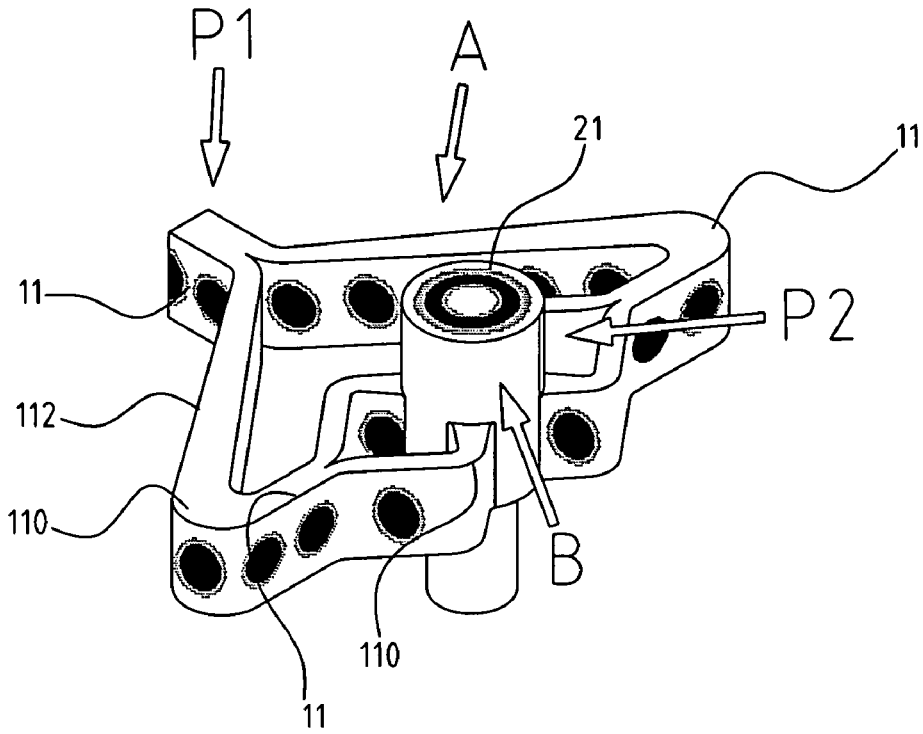
FIG. 4*a* shows a graph illustration of the distribution of the electric field strength of the converter coupler with HSFF.

FIG. 4*a* shows the distribution of the electric field strength of the converter coupler with HSFF. The mode converting process can be seen in this figure. With a radius of 6.0 mm, the cutoff frequencies for the first five modes are 14.7, 19.1, 24.3, 30.5, and 30.5 GHz for $TE_{11}$, $TM_{01}$, $TE_{21}$, $TM_{11}$, and $TE_{01}$, respectively. Therefore, when exciting the desired $TE_{01}$ mode, the concentration of the other four modes shall be kept as low as possible. The sidewall couplings rule out the possibility of exciting TM waves due to the electric field orientation. In addition, the quad-feed structure is unfavorable to $TE_{11}$ and $TE_{21}$ modes. Instead, it is suitable for a four-fold or a circular symmetric field pattern. Thus, in the operating frequency range, only the $TE_{01}$ mode could be formed and high mode purity is expected.

Figure 4B:
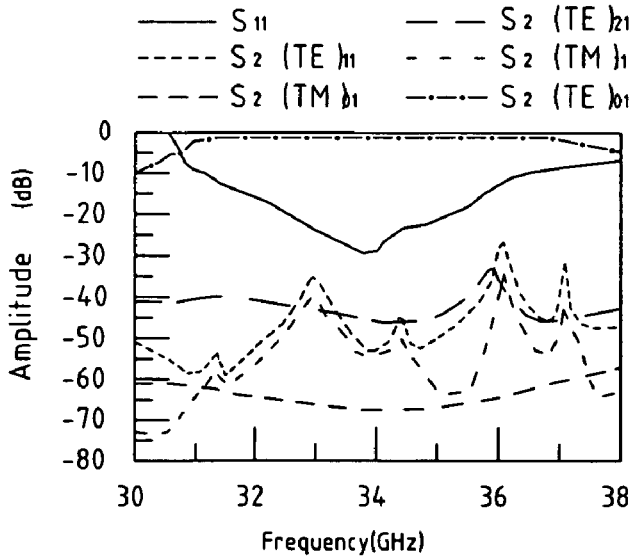
FIG. 4*b* shows a graph illustration of the first five modes' transmission losses and the reflection loss.

FIG. 4*b* shows the first five modes' transmission losses and the reflection loss. A $TE_{10}$ rectangular waveguide mode injected into port 1 can be converted to five different circular waveguide modes at port 2. The converting efficiency of a specific mode is defined as the output power of this mode at port 2 divided by the input power at port 1. The converting efficiency of the desired mode is very high, and those of the other four modes are extremely low (less than 0.1%). Close to the center frequency, the converting efficiency of the desired mode is about 98.5%, mainly due to the reflection and the ohmic loss. As to the spurious modes, all the concentrations are less than −40 dB, except for some ripples. These ripples are mainly due to the phase imbalance in the power-dividing section.

Figure 5:
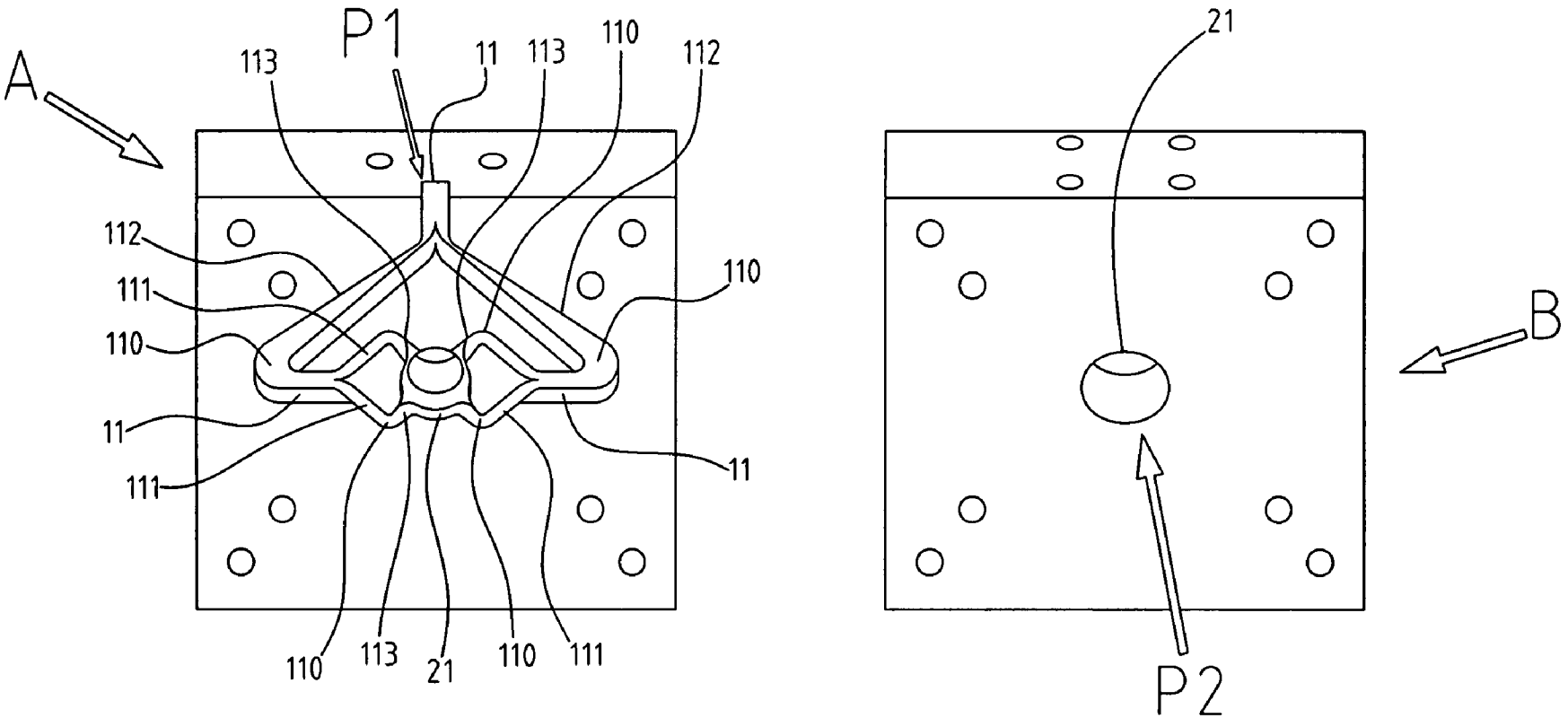
FIG. 5 shows an exploded perspective view of the model of the electromagnetic wave coupler.

FIG. 5 shows the design drawing of the coupler: electromagnetic wave power divider A and mode converter B. The rectangular $TE_{10}$ mode is converted into a polarized $TE_{01}$ mode in the main waveguide 21. All components are machined with Computer Numerical Control (CNC) lathe with a tolerance of 0.01 mm, and are aligned with pins and fastened with screws.

Figure 6A:
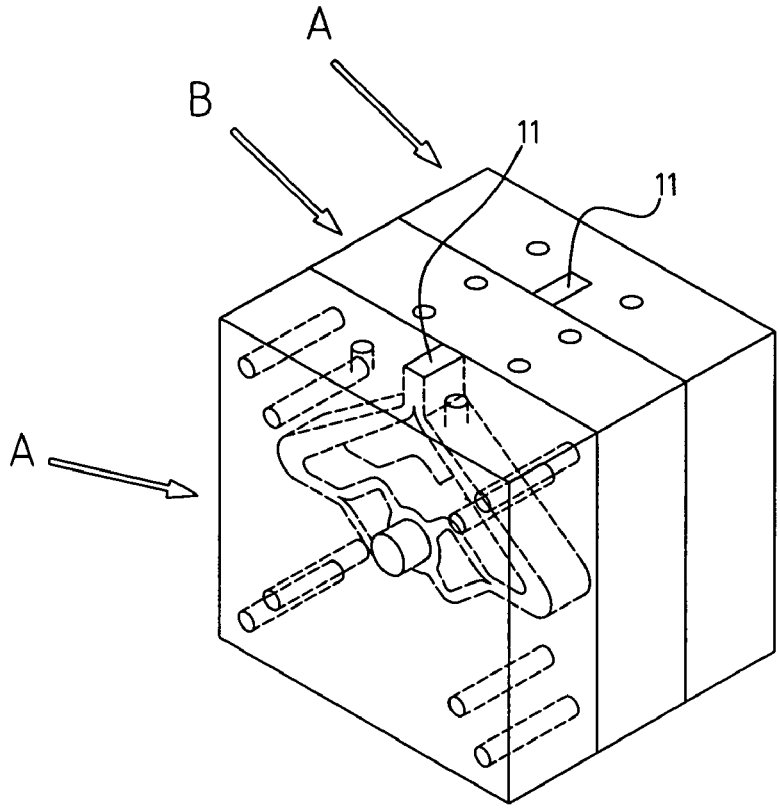
FIG. 6*a* shows a perspective view of two similar electromagnetic wave couplers.
Figure 6B:
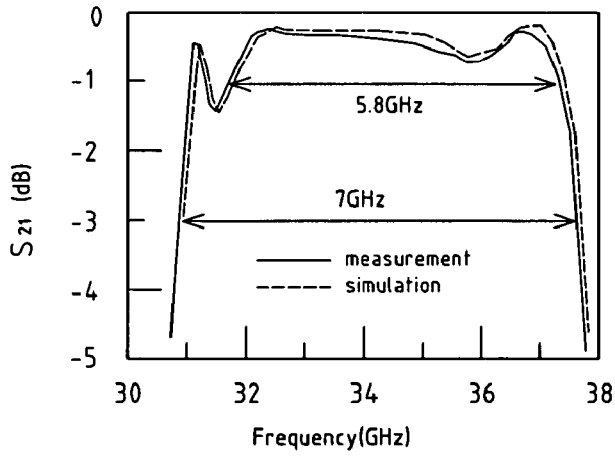
FIG. 6*b* shows a graph illustration of the transmission frequency reaction of the two similar electromagnetic wave couplers in connection.
Figure 7A:
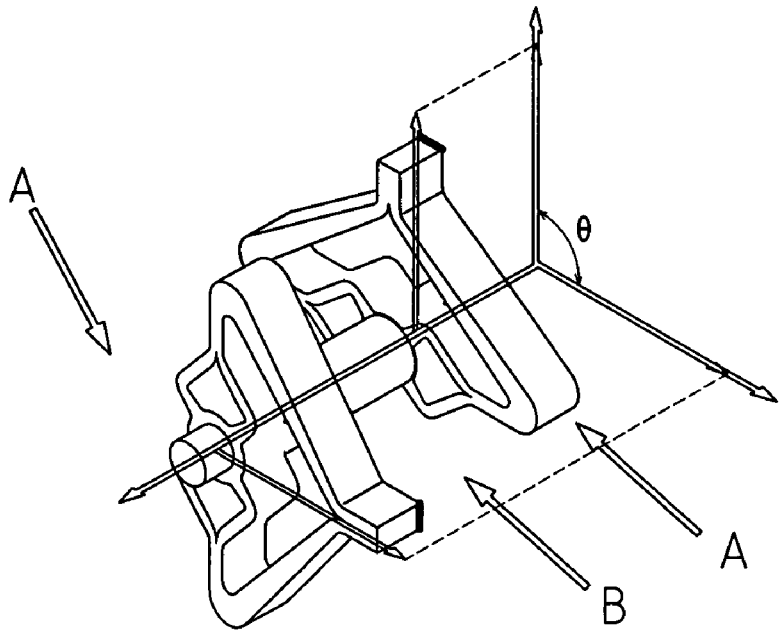
FIG. 7*a* shows a graph illustration of the HFSS electromagnetic field intensity distribution of the two identical electromagnetic wave couplers with different angles.
Figure 7B:
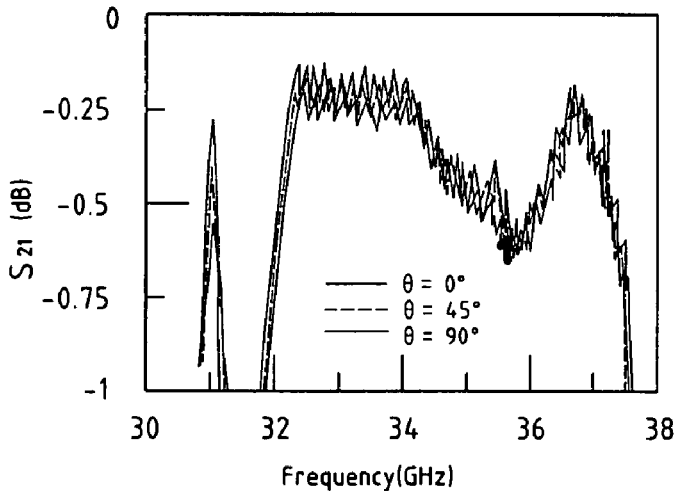
FIG. 7*b* shows a graph illustration of the transmission frequency reaction of the two identical electromagnetic wave couplers with different angles.

Two identical electromagnetic couplers are joined back-to-back to measure the mode (as seen in FIG. 6*a*), and the frequency reaction of the transmission between the two electromagnetic couplers (as seen in FIG. 6*b*) is the simulate result of two identical polarized $TE_{01}$ mode converters. Butt transmission measurement is often used to display the coupling features. The setup for the simulation and measurement is the same as shown in FIG. 5. Between the two couplers, there is a uniform middle section of 1.0 cm. A well calibrated two-port VNA (Agilent 8510C) is employed. The measured results exhibit excellent agreement with the simulation results. The ohmic loss from the metal wall accounts for the main converting loss. As shown in FIG. 7*a*, in examining the field symmetry and other competition modes, the angle θ between the two identical converters can be adjusted. Three specific angles are 0°, 45°, and 90°. FIG. 7*b* shows the transmission frequency reaction of the two identical electromagnetic wave couplers with different angles.

Figure 8:
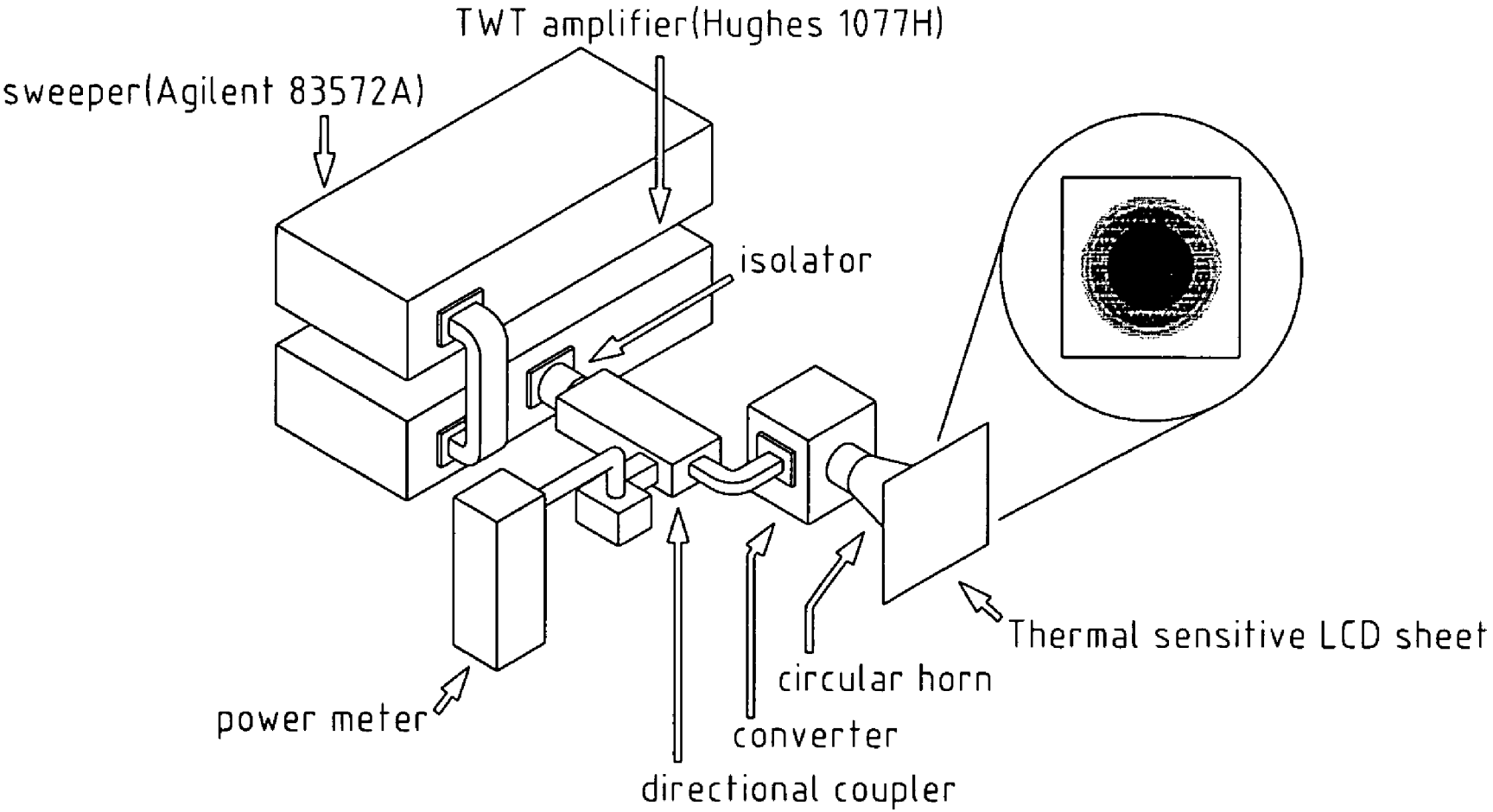
FIG. 8 shows the schematic view of a diagram of the experimental setup and result.

Although the simulation and measurement results are consistent, further evidence is required to show the effectiveness of the converting coupler. One of the methods is to show the field mode of $TE_{01}$. FIG. 8 shows the schematic diagram of the experimental setup and result. The 0.5 W RF power is provided by the traveling wave tube amplifier (Hughes 1077H) driven by a synchronizer (Agilent 8357a). A slightly tapered section is connected at the end of the converter to enlarge the size of the field pattern for visual inspection. A temperature sensitive liquid crystal display (LCD) sheet, displaying full color spectrum when the temperature changes from 25 to 30° C., is placed in front of the horn. The circular and azimuthal symmetric field pattern evidences the purity of the circular $TE_{01}$ mode. If a converting mode were mixed with a non-converting mode, irregular field distribution would appear.

We claim:

1. A high order mode electromagnetic wave coupler comprising:

an electromagnetic wave power divider having a Y-shaped bifurcated waveguides for at least one order combination dividing a wave to proportional distributing waves, the Y-shaped bifurcated waveguide having a rectangular waveguide as an input end thereof, an opposite end thereof being split into two rectangular waveguides, said Y-shaped bifurcated waveguides having a slightly tapered section and a curved waveguide connected therebetween, a last order Y-shaped bifurcated waveguide of the Y-shaped bifurcated waveguides being connected to the curved waveguide to distribute the waves to a position with a suitable angle so that the electromagnetic wave has a symmetrical magnitude after passing through said power divider; and a mode-converter having a main waveguide with corresponding coupling structures on a sidewall thereof, the electromagnetic wave being coupled by the two rectangular waveguides that are connected to the curved waveguide into a higher order mode wave.

2. The coupler of claim 1, the slightly tapered section being connected to the curved waveguide at a bifurcated end of the Y-shaped bifurcated waveguide to an opposite end of a next order Y-shaped bifurcated waveguide.

3. The coupler of claim 1, further comprising:

a settable optimized connector, said curved waveguide being connected to said mode-converter by said optimized connector.

4. The coupler of claim 1, the Y-shaped bifurcated waveguide of said electromagnetic wave power divider forms an included angle of less then 180°.

5. The coupler of claim 1, said main waveguide of said mode-converter being shaped in a cross-section thereof to be coupled between the rectangular waveguide and a cylindrical waveguide.

6. A method of high order electromagnetic wave coupling comprising:

dividing an electromagnetic wave into proportional distributing waves using a first section, said first section having an electromagnetic wave power dividing section with Y-shaped bifurcated waveguides for one or more orders combination, a slightly tapered section and a curved waveguide being connected between the Y-shaped bifurcated waveguides, a last order Y-shaped bifurcated waveguide of the Y-shaped bifurcated waveguides being connected to the curved waveguide to distribute the waves to a position with a suitable angle such that the electromagnetic wave has a symmetrical magnitude after passing through said power dividing section; and coupling the electromagnetic wave into a higher order wave using a second section, said second section having a mode converting section with a main waveguide, the electromagnetic wave being injected into rectangular waveguides connected to the curved waveguide by a connector.

* * * * *